US011473342B2

(12) United States Patent
McKibben et al.

(10) Patent No.: US 11,473,342 B2
(45) Date of Patent: Oct. 18, 2022

(54) USER SENSING EXIT DEVICE

(71) Applicant: Schlage Lock Company LLC, Carmel, IN (US)

(72) Inventors: Aaron P. McKibben, Fishers, IN (US); James W. Overbey, Indianapolis, IN (US); Yong Kwan Lacy, Carmel, IN (US); Jack R. Lehner, Jr., Indianapolis, IN (US); Jarrett Bartlett, Indianapolis, IN (US)

(73) Assignee: Schlage Lock Company LLC, Carmel, IN (US)

( * ) Notice: Subject to any disclaimer, the term of this patent is extended or adjusted under 35 U.S.C. 154(b) by 88 days.

(21) Appl. No.: 16/506,749

(22) Filed: Jul. 9, 2019

(65) Prior Publication Data

US 2019/0345738 A1 Nov. 14, 2019

Related U.S. Application Data

(62) Division of application No. 15/015,174, filed on Feb. 4, 2016, now Pat. No. 10,344,502.

(51) Int. Cl.
*E05B 65/10* (2006.01)
*E05F 15/73* (2015.01)
(Continued)

(52) U.S. Cl.
CPC ..... *E05B 65/1053* (2013.01); *E05B 47/0001* (2013.01); *E05B 47/0046* (2013.01);
(Continued)

(58) Field of Classification Search
CPC .... E05B 47/0012; E05B 47/00; E05B 65/108; E05B 2047/0091; E05B 63/0069; E05B 2047/0048; E05B 2047/0094; E05B 39/00; E05B 41/00; E05B 65/10; E05B 65/1046; E05B 65/1053; E05B 47/0001; E05B 47/0046; E05B 2047/0056;
(Continued)

(56) References Cited

U.S. PATENT DOCUMENTS 4,324,425 A 4/1982 Logan
4,763,937 A * 8/1988 Sittnick, Jr ..... E05B 49/00 292/251.5

(Continued)

*Primary Examiner* — Mark A Williams
(74) *Attorney, Agent, or Firm* — Taft Stettinius & Hollister LLP

(57) ABSTRACT

One embodiment relates to an exit device assembly. The exit device assembly includes a center case, a push pad movably mounted on the center case, and a mechanical case coupled to the center case, wherein the exit device includes an opening. The assembly also includes a sensor aligned with the opening, wherein the sensor is structured to detect a user from a distance through the opening and to generate an output signal in response to detecting the user. The assembly also includes a latch and a latch actuator. The assembly also includes a controller in communication with the sensor and the latch actuator, wherein the controller is structured to transmit an actuating signal in response to receiving the output signal from the sensor, wherein the latch actuator is configured to move the latch from the locked position to the unlocked position in response to the actuating signal.

20 Claims, 9 Drawing Sheets

(51) Int. Cl.
*E05F 15/77* (2015.01)
*E05F 15/75* (2015.01)
*E05B 47/00* (2006.01)

(52) U.S. Cl.
CPC ..... *E05B 65/108* (2013.01); *E05F 15/73* (2015.01); *E05F 15/75* (2015.01); *E05F 15/77* (2015.01); *E05B 2047/0048* (2013.01); *E05B 2047/0056* (2013.01); *E05B 2047/0091* (2013.01)

(58) Field of Classification Search
CPC ..... G07C 2009/00769; G07C 2009/00865; Y10T 292/0908; Y10T 292/1021; Y10T 70/5159; Y10T 292/1082; Y10T 292/0822; Y10T 70/7051; Y10S 292/65; E05F 15/73; E05F 15/75; E05F 15/77
See application file for complete search history.

(56) References Cited

U.S. PATENT DOCUMENTS 4,871,204 A 10/1989 Cook et al.
4,875,722 A 10/1989 Miller et al.
4,893,852 A 1/1990 Harris et al.
5,011,199 A 4/1991 Lowe et al.
5,479,151 A 12/1995 Lavelle et al.
5,517,176 A 5/1996 Lavelle et al.
5,525,880 A 6/1996 Geringer et al.
5,564,228 A 10/1996 Geringer et al.
5,969,440 A 10/1999 Young et al.
6,023,224 A * 2/2000 Meyvis ..... E05B 47/00 340/545.1
6,386,597 B1 5/2002 Walsh, III
6,386,897 B1 5/2002 Muller
6,486,793 B1 * 11/2002 Buccola ..... E05C 19/166 292/1.5
7,051,560 B2 5/2006 Sanchirico, Jr. et al.
8,284,018 B2 * 10/2012 Ibsies ..... E05B 41/00 340/3.1
8,978,305 B2 * 3/2015 Morstatt ..... E05B 47/026 49/394
2011/0067308 A1 3/2011 Hunt et al.
2012/0169072 A1 * 7/2012 Maguire ..... E05B 65/025 292/336.3
2013/0237193 A1 9/2013 Dumas et al.
2013/0285393 A1 * 10/2013 Roatis ..... E05B 47/0673 292/336.3
2014/0265359 A1 * 9/2014 Cheng ..... E05B 47/026 292/144
2014/0267739 A1 * 9/2014 Ibsies ..... H04N 7/183 348/156
2015/0184426 A1 7/2015 Arlinghaus et al.
2015/0194000 A1 * 7/2015 Schoenfelder ..... G07C 9/00309 340/5.61
2016/0055694 A1 2/2016 Saeedi et al.
2016/0319570 A1 11/2016 Wong et al.
2016/0353548 A1 12/2016 Davis
2018/0016836 A1 1/2018 Ibsies

* cited by examiner

USER SENSING EXIT DEVICE

CROSS-REFERENCE TO RELATED APPLICATIONS

The present application is a divisional of U.S. patent application Ser. No. 15/015,174 filed Feb. 4, 2016 and issued as U.S. Pat. No. 10,344,502, the contents of which are incorporated herein by reference in their entirety.

TECHNICAL FIELD

The present application generally relates to an exit device, and more particularly but not exclusively relates to a door mounted exit device which is operable to sense an approaching user and unlatch a latch in response to sensing the approaching user.

BACKGROUND

Present exit device assemblies suffer from a variety of limitations and problems such as high power consumption and high system installation costs. For example, certain exit device assemblies requires the user to exert a significant force in order to actuate a door latch. In some instances, a disabled or elderly user is incapable of exerting the amount of force necessary to actuate the door latch. In another example, a latch may be actuated in response to a wall mounted button or sensor, which requires time consuming installation steps such as wire routing through walls. Therefore, a need exists for further technological developments in the area of access control devices.

SUMMARY

In one embodiment, an exit device assembly includes a center case, a push pad movably mounted on the center case, and a mechanical case coupled to the center case, wherein the exit device includes an opening. The assembly also includes a sensor aligned with the opening, wherein the sensor is structured to detect a user from a distance through the opening and to generate an output signal in response to detecting the user. The assembly also includes a latch and a latch actuator. The assembly also includes a controller in communication with the sensor and the latch actuator, wherein the controller is structured to transmit an actuating signal in response to receiving the output signal from the sensor, wherein the latch actuator is configured to move the latch from the locked position to the unlocked position in response to the actuating signal. Further embodiments, forms, features, and aspects of the present application shall become apparent from the description and figures provided herewith.

DETAILED DESCRIPTION OF ILLUSTRATIVE EMBODIMENTS

Figure 2:
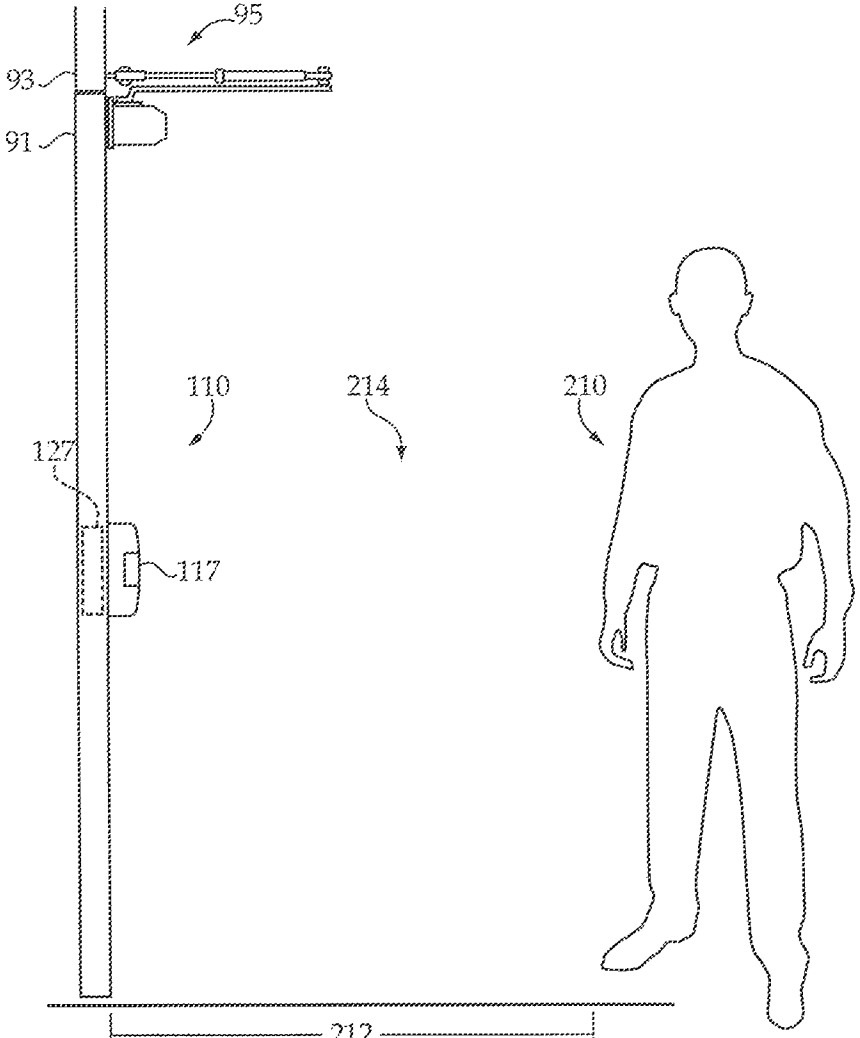
FIG. 2 illustrates a door operation system according to another embodiment.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

As used herein, the terms "longitudinal," "lateral," and "transverse" are used to denote motion or spacing along three mutually perpendicular axes, wherein each of the axes defines two opposite directions. In the coordinate system illustrated in FIGS. 4 and 5, the X-axis defines first and second longitudinal directions, the Y-axis defines first and second lateral directions, and the Z-axis defines first and second transverse directions. The directions defined by each axis may be referred to as positive and negative directions, wherein the arrow of the axis indicates the positive direction.

Additionally, the descriptions that follow may refer to the directions defined by the axes with specific reference to the orientations illustrated in the Figures. For example, the longitudinal directions may be referred to as "distal" ($X^+$) and "proximal" ($X^-$), the lateral directions may be referred to as "forward" ($Y^+$) and "rearward" ($Y^-$), and the transverse directions may be referred to as "up" ($Z^+$) and "down" ($Z^-$). These terms are used for ease and convenience of description, and are without regard to the orientation of the system with respect to the environment. For example, descriptions that reference a longitudinal direction may be equally applicable to a vertical direction, a horizontal direction, or an off-axis orientation with respect to the environment.

Furthermore, motion or spacing along a direction defined by one of the axes need not preclude motion or spacing along a direction defined by another of the axes. For example, elements which are described as being "laterally offset" from one another may also be offset in the longitudinal and/or transverse directions, or may be aligned in the longitudinal and/or transverse directions. The terms are therefore not to be construed as limiting the scope of the subject matter described herein.

Figure 1:
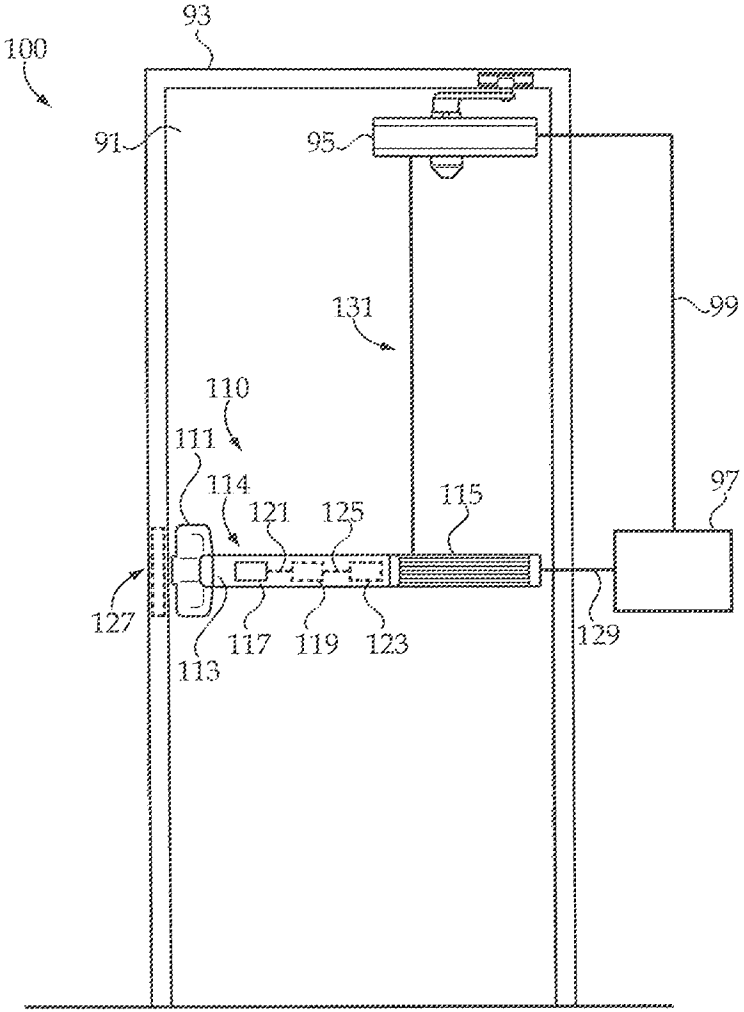
FIG. 1 illustrates a door operation system according to one embodiment.

With reference to FIGS. 1 and 2, illustrated therein is a door operation system 100 including a door 91, a door frame 93, a powered door operator 95, a power supply 97, and an exit device assembly 110. The exit device assembly 110 may, for example, include an exit device of the type described below with reference to FIGS. 4 and 5. The door 91 is coupled to the door frame 93 and is pivotable between a closed position and an open position. The operator 95 is coupled to the door 91 and the door frame 93, and is structured to move the door 91 between the closed position and the open position. The operator 95 is structured to receive power from the power supply 97 by way of a power distribution line 99. As illustrated in FIG. 2, a user 210 is approaching the door 91, and is located a predetermined distance 212 from the exit device assembly 110.

The exit device assembly 110 is mechanically coupled to the door 91 with a rear face of the exit device assembly 110 abutting a front face of the door 91. The exit device assembly 110 includes a housing assembly 140 including a mechanical case 111, a push pad 113, and a center case 115. The exit device assembly 110 further includes a sensor 117, a controller 119, a latch actuator 123, and a latch 127. As described in further detail below, the sensor 117 is aligned with an opening 114 in the housing assembly 140, and is structured to detect the presence of the user 210 when the user 210 is within the predetermined distance 212 of the exit device assembly 110. In the illustrated embodiment, the opening 114 is formed in a front surface of the push pad 113. In other embodiments, the opening 114 may additionally or alternatively be formed in a front surface of the mechanical case 111 and/or the center case 115.

The sensor 117 is coupled to the push pad 113 and is aligned with the opening 114 of the pad 113. The sensor 117 is structured to detect the user 210 before the user 210 reaches the exit device 110 or exerts a force on the door 91. The sensor 117 may be configured to detect the user 210 in response to the user 210 performing a predetermined gesture. For example, the sensor 117 may detect the user 210 as the user 210 approaches the door 91, or the sensor 117 may detect the user 210 when the user 210 waves a hand in front of the sensor 117. The sensor 117 may be a proximity sensor, a motion sensor, an infrared sensor, an optical sensor, or any other type of sensor structured to detect a user 210 from a distance and generate an output signal in response to detecting a user. The sensor 117 may receive power from the power supply 97 or a battery housed in the exit device assembly 110.

The sensor 117 is in communication with the controller 119, and is structured to generate an output signal in response to detecting the user 210. In the illustrated form, the sensor 117 is in communication with the controller 119 by way of a wire 121, and the controller 119 is in communication with the latch actuator 123 by way of a wire 125. In other embodiments, the controller 119 may be in wireless communication with the sensor 117 and/or the latch actuator 123. The controller 119 is electrically coupled to the power supply 97 and is structured to receive power from the power supply 97 by way of power distribution line 129. In other embodiments, the controller 119 may receive power from a battery housed in the exit device assembly 110 instead of receiving power from the power supply 97.

As indicated above, the controller 119 is in communication with the sensor 117 and the latch actuator 123. The controller 119 may include an electrical circuit of the type described below with respect to FIG. 11. The controller 119 is structured to receive the output signal from the sensor 117 and transmit an actuating signal to the latch actuator 123 in response to receiving the output signal from the sensor 117. In the illustrated embodiment, the actuating signal is transmitted from the controller 119 to the latch actuator 123 by way of the wire 125. In other embodiments, the actuating signal is transmitted from the controller 119 to the latch actuator 123 by way of a wireless communication. The controller 119 is structured to transmit the actuating signal to the latch actuator 123 before the user reaches the door in response to the sensor 117 sensing the user.

The latch actuator 123 is structured to move a latch 127 between a latched stated and an unlatched state. The latch actuator 123 is structured to receive power from the power supply 140 and move the latch 127 between the unlatched and latched states in response to receiving the actuating signal from the controller 119. In certain embodiments, the latch 127 may include an electric strike, and the latch actuator 132 may be operable to move the electric strike from the latched state to the unlatched state. In other embodiments, the latch 127 may include a latchbolt having an extended position in the latched state and a retracted position in the unlatched state. In such forms, the latchbolt may be moved from the extended position to the retracted position by each of the push pad 113 and the latch actuator 132.

In the illustrated embodiment, the controller 119 is structured to receive the output signal generated by the sensor 117 and transmit an actuating signal to the latch actuator 123 and the powered door operator 95. The controller 119 is electrically coupled to the powered door operator 95 by way of a wire 131. The powered door operator 95 is structured urge the door 91 from the closed position toward the open position in response to receiving an actuating signal from the controller 119. In certain embodiments, the door operator 95 may be operable to move the door 91 from the closed position to the open position without requiring the user 210 to exert a force on the door 91. In other embodiments, the user 210 may be required to exert a predetermined amount of force on the door, such as five pounds or less, in order to move the door 91 from the closed position to the open position.

While the embodiments described hereinafter may not specifically describe features analogous to the features of system 100, such features may nonetheless be employed in connection with the described systems.

Figure 3:
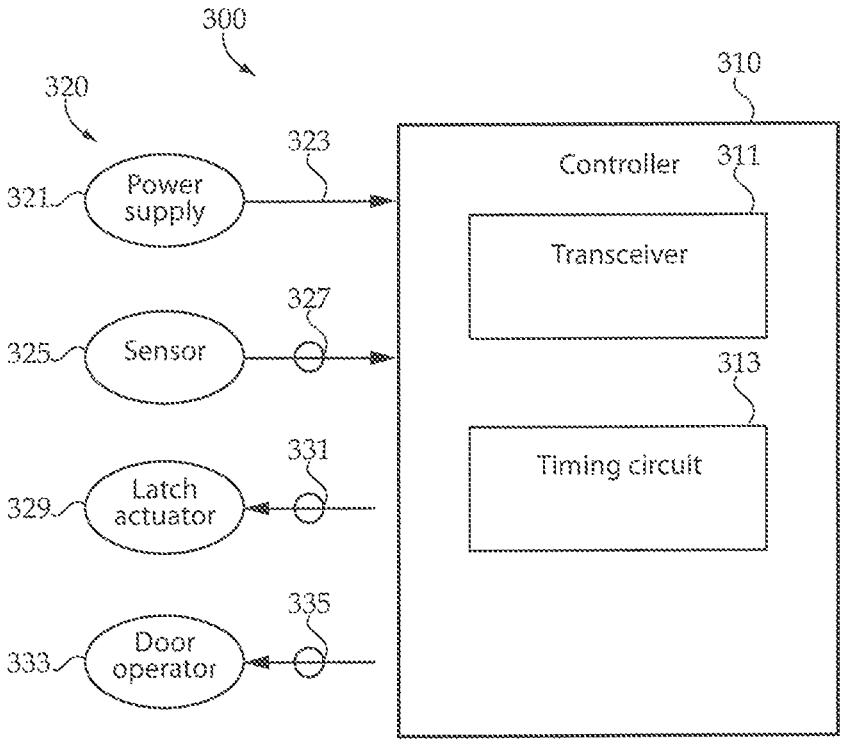
FIG. 3 is a schematic block diagram illustrating an exemplary controller.

With reference to FIG. 3, there is illustrated an exemplary controller system 300 having a controller 310 electronically coupled to a plurality of external devices 320 including a power supply 321 operable to supply power to the controller 310, a sensor 325, a latch actuator 329, and a powered door operator 333. The power supply 321, sensor 325, latch actuator 329, and powered door operator 333 may, for example, take the form of the corresponding elements and features described above with reference to FIGS. 1 and 2. The controller 310 includes a transceiver 311 in communication with the sensor 325, the latch actuator 329, and the powered door operator 333. The controller 310 further includes a timing circuit 313 structured to transmit an actuating signal 331 to the latch actuator 329 and an operator signal 335 to the powered door operator 333 in response to receiving an output signal 327 from the sensor 325. In certain embodiments, the timing circuit 313 may transmit the actuating signal 331 for a time period defined by a user.

Figure 4:
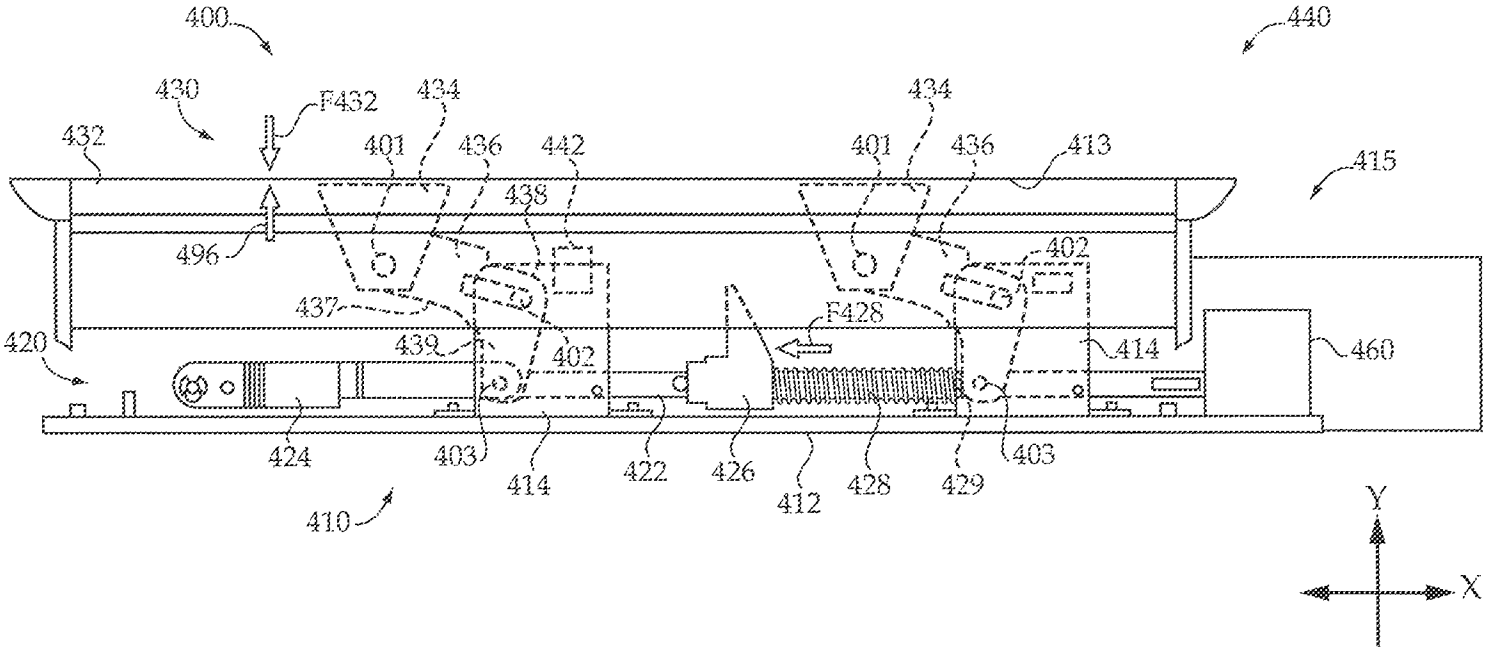
FIG. 4 is an elevational illustration of an exit device assembly according to one embodiment.
Figure 5:
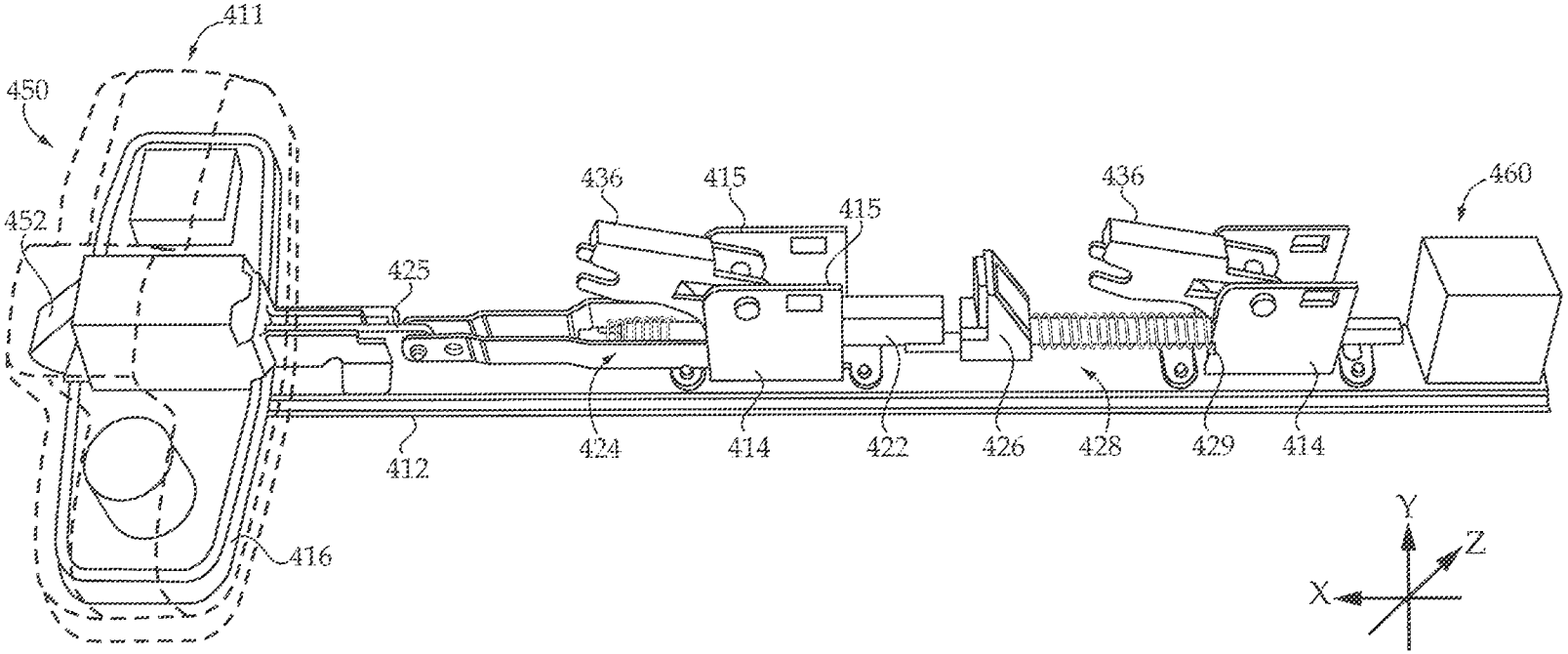
FIG. 5 is a perspective illustration of the exit device assembly illustrated in FIG. 4.

With reference to FIGS. 4 and 5, an exit device 400 which may be utilized in certain embodiments generally includes a mounting assembly 410 configured for mounting on a surface of a door, and a drive assembly 420 supported on the mounting assembly 410. The drive assembly 420 has an extended state and a retracted state, and includes a push pad assembly 430 operable to transition the drive assembly 420 between the extended and retracted states. The exit device 400 also includes a housing assembly 440 including a mechanical case 411, a push pad 413, and a center case 415. The exit device 400 may further include a latchbolt mechanism 450 operatively coupled with the drive assembly 420 and/or a latch actuator 460 operable to actuate the latchbolt mechanism 450. As described in further detail below, the latchbolt mechanism 450 includes a latchbolt 452, and the drive assembly 420 retracts the latchbolt 452 in response to actuation of the push pad assembly 430. In embodiments which include the latch actuator 460, the latch actuator 460 may be operable to actuate the latchbolt mechanism via the drive assembly 420 in response to an actuating signal from a controller.

The mounting assembly 410 generally includes a base plate 412 configured for mounting on a door, and a pair of mounting brackets 414 coupled to the base plate 412. Each of the mounting brackets 414 includes a pair of transversely spaced walls 415, which extend laterally away from the base plate 412. The mounting assembly 410 may further include a header plate 416, on which the latchbolt mechanism 450 may be mounted. Additionally, a mechanical case 411 may be mounted on the header plate 416 to enclose the latchbolt mechanism 450.

The drive assembly 420 generally includes a drive bar 422, a fork link 424 coupled to a proximal end of the drive bar 422, a collar 426 including a laterally-extending arm 427 and coupled to the drive bar 422, and a biasing element urging the drive assembly 420 toward the extended state. While other forms are contemplated, the illustrated biasing element is a main compression spring 428 through which the drive bar 422 extends. The drive assembly 420 may also include a link bar 425 coupling the drive assembly 420 to the latchbolt mechanism 450. The drive bar 422 is longitudinally movable in a proximal direction ($X^+$) and a distal direction ($X^-$).

Movement of the drive bar 422 is transmitted via the fork link 424 and the link bar 425 to the latchbolt mechanism 450. More specifically, movement of the drive bar 422 in the proximal or extending direction causes the latchbolt 452 to extend toward a latching position, and movement of the drive bar 422 in the distal or retracting direction causes the latchbolt 452 to retract toward an unlatching position. As such, the proximal direction may be considered a bolt-extending direction, and the distal direction may be considered a bolt-retracting direction.

In the illustrated form, the main spring 428 is compressed between the collar 426 and the distal mounting bracket 414. More specifically, the proximal end of the compression spring 428 is engaged with the collar 426, and the distal end of the compression spring 428 is engaged with the distal mounting bracket 414 through a washer 429. The distal mounting bracket 414 acts as an anchor for the washer 429, such that the compressed spring 428 exerts a main spring biasing force F428 on the collar 426. The biasing force F428 is an extensive biasing force urging the drive assembly 420 toward the extended state. In other forms, an extensive biasing force may be exerted on the drive assembly 420 in another manner.

The drive assembly 420 also includes a push pad assembly 430, which generally includes a manually-actuable push pad 432, a pair of push pad brackets 434 coupled to the push pad 432, and a pair of bell cranks 436 coupling the push pad 432 with the drive bar 422. The push pad 432 is laterally movable between an extended or forward position and a retracted or rearward position. As described in further detail below, the bell cranks 436 translate lateral movement of the push pad 432 to longitudinal movement of the drive bar 422. Each of the bell cranks 436 includes a first arm 437, a center portion 438, and a second arm 439 angularly offset from the first arm 437. Each of the first arms 437 is pivotally connected to one of the push pad brackets 434 by a first pivot pin 401, each of the center portions 438 is pivotally connected to one of the mounting brackets 414 by a second pivot pin 402, and each of the second arms 439 is pivotally connected to the drive bar 422 by a third pivot pin 403.

During operation of the exit device 400, a user manually actuates the drive assembly 420 by exerting an actuating force F432 sufficient to move the push pad 432 from the extended position to the retracted position. As the push pad 432 moves laterally inward (i.e. toward the base plate 412), the bell cranks 436 pivot about the pins 402 in the counter-clockwise direction (as viewed in FIG. 4). As the bell cranks 436 pivot, the second arms 439 urge the drive bar 422 in the distal or retracting direction against the biasing force of the spring 428, thereby causing the latchbolt 452 to retract. When the actuating force F432 is removed from the push pad 432, the compressed spring 428 urges the drive bar 422 in the proximal or bolt-extending direction, causing the latchbolt 452 to extend. As the drive bar 422 moves in the bolt-extending direction, the bell cranks 436 pivot about the center portions 438 in the illustrated clockwise direction (as viewed in FIG. 4), thereby urging the push pad 432 toward the extended position thereof.

In certain circumstances, it may be desirable to eliminate or reduce the user-driven element of the actuating force required to retract the latchbolt 452. In such a case, an exit device such as the exit device 400 may include an electrical circuit operable to actuate the latchbolt 452. Exemplary forms of actuating electrical circuits are described with reference to FIGS. 1-2 and 7-12. The electrical circuit includes a controller structured to transmit an actuating signal to the latch actuator 460, thereby retracting the latchbolt 452.

While the following descriptions are made with reference to the exit device 400 and elements and features thereof, it is to be understood that at least some of the actuating electrical circuitry may be utilized in combination with exit devices of other configurations. Additionally, at least some of the actuating electrical circuitry need not be included in an exit device at the time of sale. For example, certain actuating electrical circuitry may be configured for use with a particular configuration of exit device, and may be manufactured and sold as a retrofit kit for such exit devices.

Figure 6:
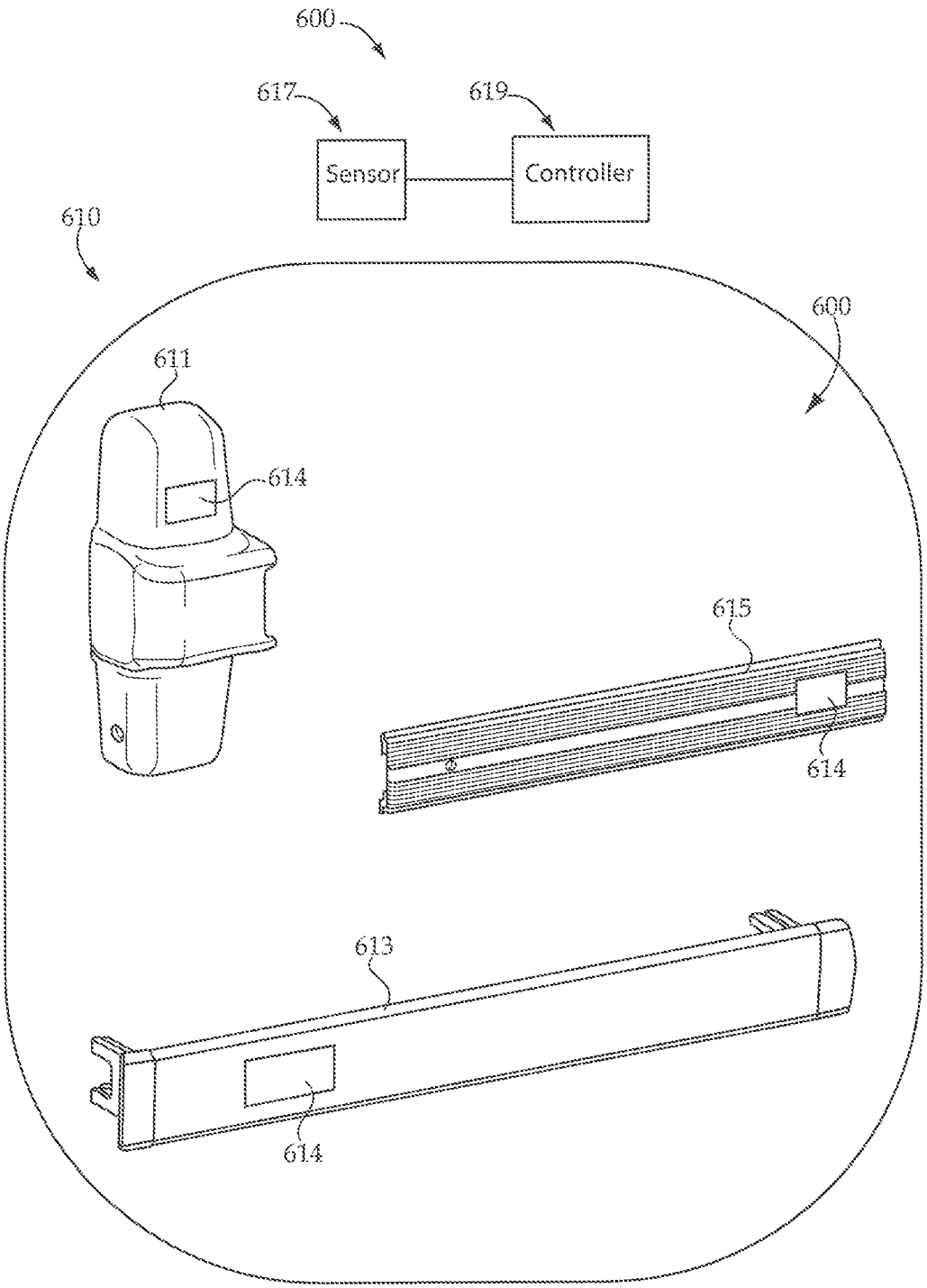
FIG. 6 illustrates a retrofit kit according to one embodiment.

FIG. 6 illustrates a retrofit kit 600 according to one embodiment. The retrofit kit 600 is structured for use with an exit device including one of a mechanical case, a push pad, and a center case. In the illustrated form, the retrofit kit 600 is configured for use with the above-described exit device 400, which includes the mechanical case 411, push pad 413, and center case 415. The retrofit kit 600 includes at least one retrofit plate 610 and a sensor 617. The retrofit plate 610 is configured to replace an existing element of the housing assembly 440, and includes an opening 614. For example, the retrofit plate 610 may be provided as a retrofit mechanical case 611 structured to replace the existing mechanical case 411, a retrofit push pad 613 structured to replace the existing push pad 413, or a retrofit center case 615 structured to replace the existing center case 415. The retrofit plate 610 includes an opening 614, and the sensor 617 is structured to be mounted on the retrofit plate 610 in alignment with the opening 614. The retrofit kit 600 may further include an actuating electrical circuit such as a controller 619 structured to receive an output signal from the sensor 617.

Figure 7:
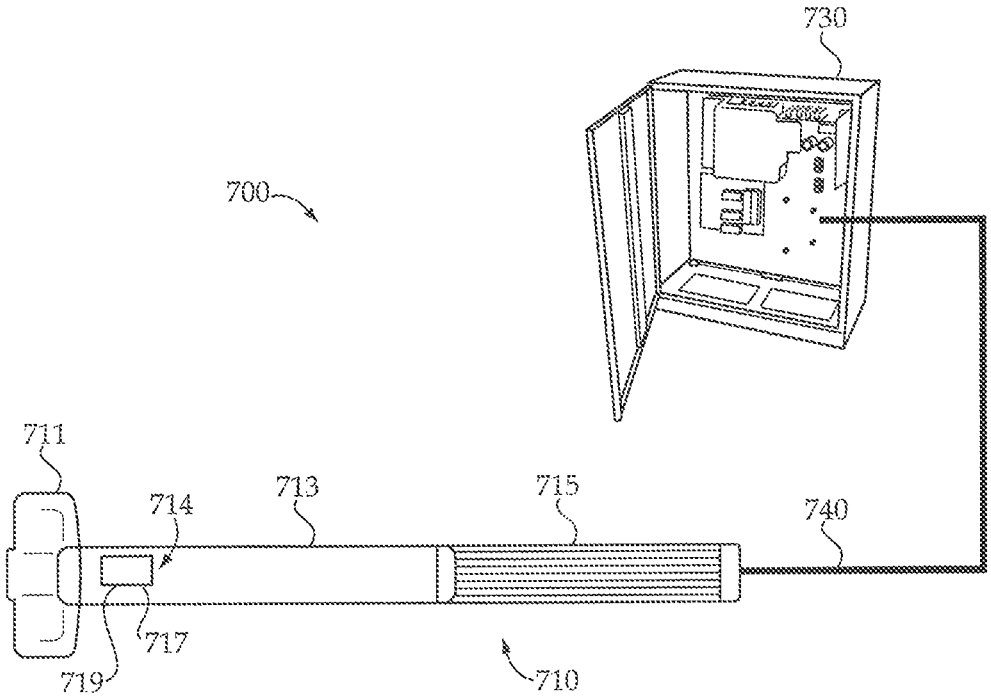
FIGS. 7-10 are schematic illustrations of door operation systems according to additional embodiments.

Referring to FIG. 7, there is illustrated an exemplary door exit system 700. The system 700 includes an exit device assembly 710 electrically coupled to a power supply 730 by way of a power supply line 740. The assembly 710 includes a center case 711, a push pad 713 movably mounted on the center case 711, and a mechanical case 715 coupled to the center case 711. In the illustrated embodiment, the push pad 713 includes an opening 714 formed on the front surface of the push pad 713. In other embodiments, the center case 711 or the mechanical case 715 may include an opening formed on the front surface thereof. The exit device assembly 710 further includes a sensor 717 coupled to the pad 713 and aligned with the opening 714. The assembly 710 further includes a controller 719, which is incorporated into the sensor 717 in the illustrated embodiment.

With additional reference to FIGS. 1-5, the door exit system 700 may, for example, be provided as an implementation of the system 100 with the exit device 400. In such embodiments, the latchbolt mechanism 450 may be mounted in the mechanical case 715, and the latch actuator 460 may be mounted in the center case 717. As the user 210 approaches the exit device 400, the user 210 enters a sensing region 214. When the user 210 is located within the predetermined distance 212, the sensor 717 senses the user 210 and generates the output signal 327. In response to the output signal 327, the controller 719 issues an actuating signal 331 to the actuator 460. In response to the actuating signal 331, the actuator 460 retracts the actuation bar 412, thereby retracting the latchbolt 452. The actuation bar 412 is retracted before the user 210 reaches the door 91. Thus, the latchbolt 452 is retracted in response to the actuating signal 331 without the exertion of force on the push pad 719 by the user 210.

Figure 8:
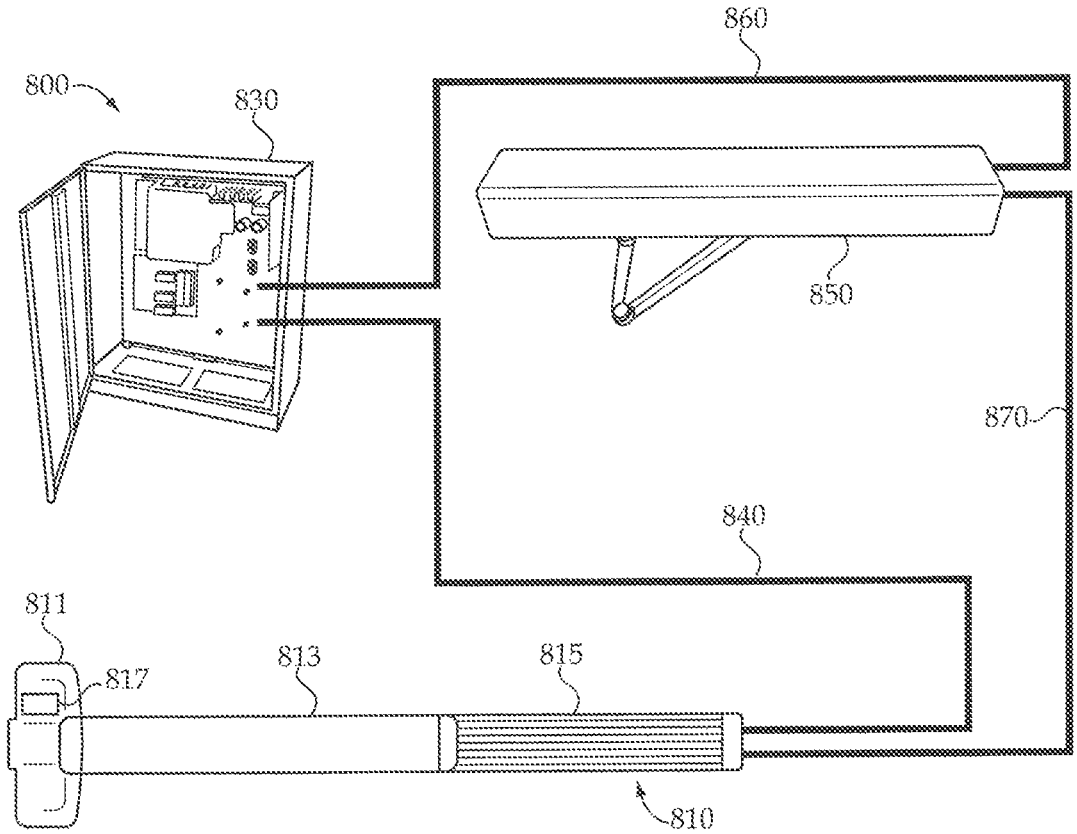

Referring to FIG. 8, there is illustrated an exemplary door exit system 800. The system 800 includes an exit device assembly 810, a power supply 830 coupled to exit device assembly 810 by way of a power supply line 840, a powered door operator 850 coupled to the power supply 830 by way of a power distribution line 860 and coupled to the assembly 810 by way of a signal line 870.

The exit device assembly 810 includes a center case 811, a push pad 813 movably mounted on the center case 811, and a mechanical case 815 coupled to the center case 811. The mechanical case 815 includes an opening 814 formed in the front surface and is structured to house a latch and latch actuator. A sensor 817 is aligned with the opening of the mechanical case 815. A controller 819 is housed within the assembly 810.

With additional reference to FIGS. 1-5, the door exit system 800 may, for example, be provided as an implementation of the system 100 with the exit device 400. In such embodiments, the latchbolt mechanism 450 may be mounted in the mechanical case 815, and the latch actuator 460 may be mounted in the center case 817. As the user 210 approaches the exit device 400, the user 210 enters a sensing region 214. When the user 210 is located within the predetermined distance 212, the sensor 817 senses the user 210 and generates the output signal 327. In response to the output signal 327, the controller 819 issues an actuating signal 331 to the actuator 460. In response to the actuating signal 331, the actuator 460 retracts the actuation bar 412, thereby retracting the latchbolt 452. The actuation bar 412 is retracted before the user 210 reaches the door 91. Thus, the latchbolt 452 is retracted in response to the actuating signal 331 without the exertion of force on the push pad 719 by the user 210.

Figure 9:
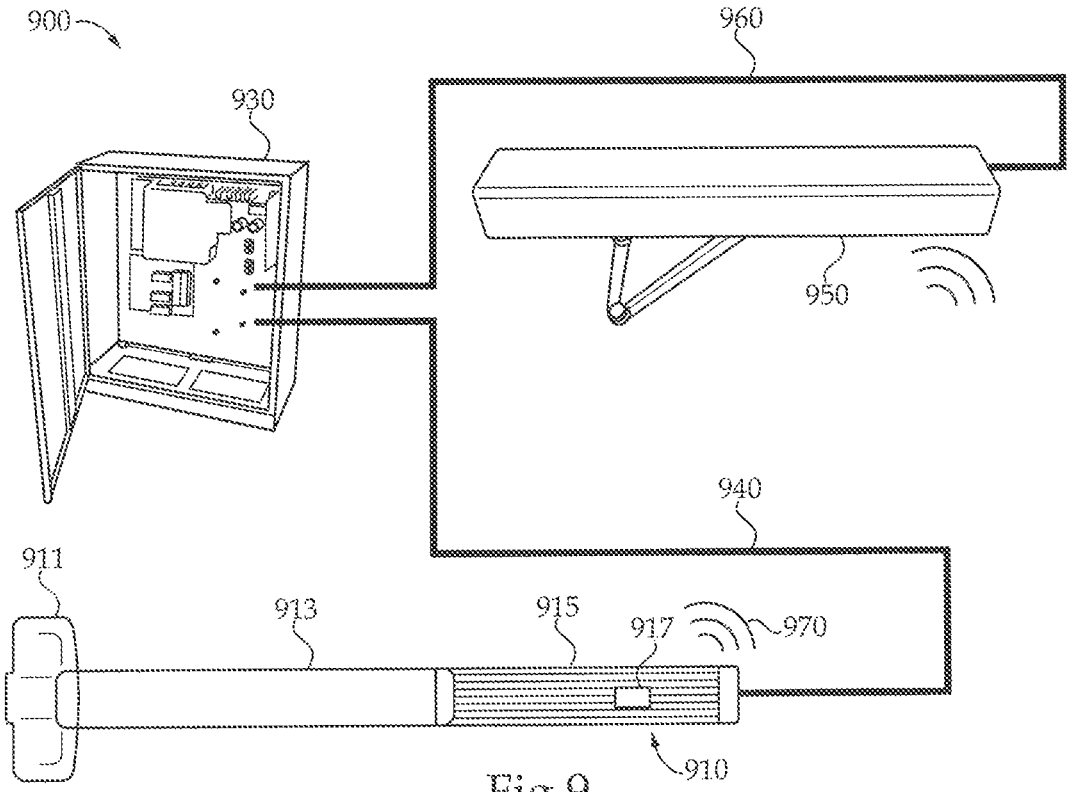

Referring to FIG. 9, there is illustrated an exemplary door exit system 900. The system 900 includes an exit device assembly 910, a power supply 930 coupled to exit device assembly 910 by way of a power supply line 940, a powered door operator 950 coupled to the power supply 940 by way of a power distribution line 960.

The exit device assembly 910 includes a retrofit kit assembly having a retrofit plate 911. The assembly 910 further includes a push pad 913 movably mounted on the plate 911, and a mechanical case 915 coupled to the plate 911. The retrofit kit assembly further comprises a sensor 920 aligned with the opening in the retrofit plate 911 and coupled to the retrofit plate 911. The retrofit kit assembly further comprises a controller structured to receive the output signal from the sensor 920 and to transmit an actuating signal to the latch actuator and an operating signal 970 to the powered door operator 950 in response to the output signal. As illustrated in FIG. 9, the controller may transmit an operating signal 970 to the power door operator 950 by way of a wireless communication. The controller 919 may transmit an actuating signal 970 or receive an output signal by way of wireless or wired communication.

With additional reference to FIGS. 1-5, the door exit system 900 may, for example, be provided as an implementation of the system 100 with the exit device 400. In such forms, the latchbolt mechanism 450 may be mounted in the mechanical case 715, and the latch actuator 460 may be mounted in the center case 917. As the user 210 approaches the exit device 400, the user 210 enters a sensing region 214. When the user 210 is located within the predetermined distance 212, the sensor 917 senses the user 210 and generates the output signal 327. In response to the output signal 327, the controller 919 issues an actuating signal 331 to the actuator 460. In response to the actuating signal 331, the actuator 460 retracts the actuation bar 412, thereby retracting the latchbolt 452. The actuation bar 412 is retracted before the user 210 reaches the door 91. Thus, the latchbolt 452 is retracted in response to the actuating signal 331 without the exertion of force on the push pad 719 by the user 210.

Figure 10:
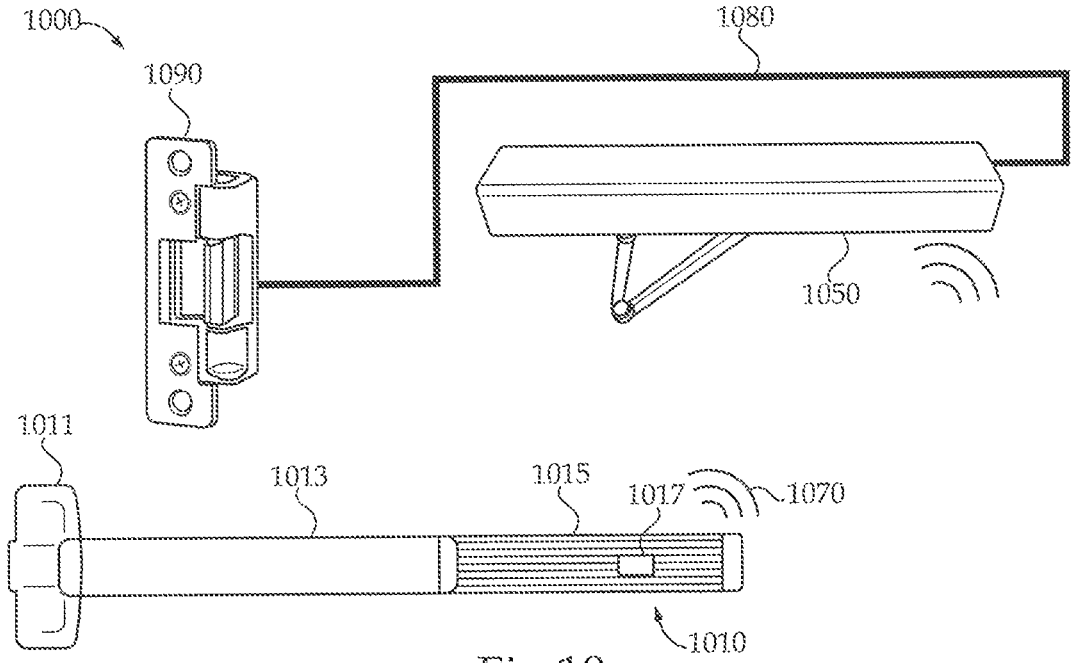

Referring to FIG. 10, there is illustrated an exemplary door exit system 1000. The system 1000 includes an exit device assembly 1010, a powered door operator 1050, a power line 1080, and an electric strike 1090. The assembly 1010 includes a center case 1011, a push pad 1013 movably mounted on the center case 1011, and a mechanical case 1015 coupled to the center case 1011. A controller housed within the exit device assembly 1010 is structured to transmit an actuating signal 1070 to an electric strike 1090 and the powered door operator 1050 by way of a wireless communication. The powered door operator 1050 is structured to operate the electric strike 1090 in response to the wirelessly transmitted actuating signal 1070 from the controller.

With additional reference to FIGS. 1-5, the door exit system 1000 may, for example, be provided as an implementation of the system 100. In such embodiments, the electric strike 1090 may be mounted on the door frame 93. As the user 210 approaches the exit device 400, the user 210 enters a sensing region 214. When the user 210 is located within the predetermined distance 212, the sensor 917 senses the user 210 and generates the output signal 327. In response to the output signal 327, the controller 919 issues an actuating signal 331 to the electric strike 1090 by way of the powered door operator 1050. In response to the actuating signal 331, the electric strike 1090 transitions to an unlatched state, thereby allowing the user to open the door 91. The electric strike 1090 transitions to the unlatched state before the user 210 reaches the door 91.

Figure 11:
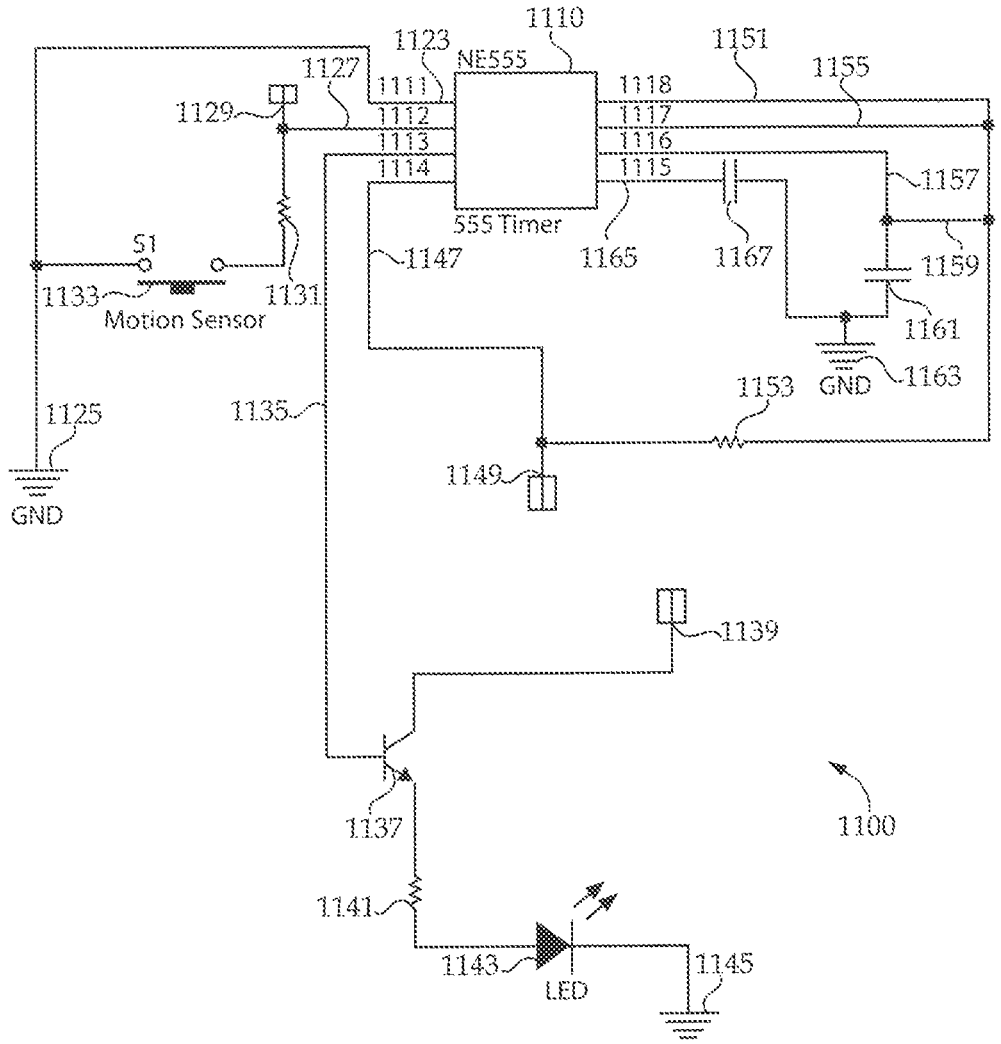
FIG. 11 is a circuit diagram illustrating a controller according to another embodiment.

Referring to FIG. 11, there is illustrated an actuation electrical circuitry 1100 which may be utilized in connection with certain embodiments. The circuit 1100 includes an integrated circuit chip 1110 having pins 1111-1118. In the illustrated embodiment, the chip 1110 is an NE555 precision timing circuit. In other embodiments, the chip 1110 may be another timing circuit structured to generate an output signal following a period of time after receiving an input signal.

The chip 1110 is structured to couple to a ground 1125 by way of the pin 1111. The chip 1110 is structured initiate a timing sequence in response to receiving an active low signal by way of the pin 1112. The chip 1110 is structured to transmit an output signal during the time sequence by way of the pin 1113. The chip 1110 is structured to reset the timing sequence in response to receiving an active low signal by way of the pin 1114. The chip 1110 is structured to output a voltage at the pin 1115 of approximately two thirds of the input voltage received at the pin 1118. The chip 1110 is structured to receive a threshold voltage value by way of the pin 1116. The chip 1110 is structured to discharge a timing capacitor by way of the pin 1117.

The pin 1111 of the chip 1110 is coupled with a ground 1125 by way of line 1123. The pin 1112 of the chip 1110 is selectively coupled to the ground 1125 by way of a resistor 1111 and a sensor 1113. In the illustrated embodiment, the sensor 1133 is a motion sensor. The sensor may be any of the sensors described previously in other embodiments. In the illustrated embodiment, the resistor 1131 is a 10,000 Ohm resistor. The resistor 1111 may be of any size sufficient to safely limit the current passing through the sensor 1133 to the ground 1125.

A power source 1129 is coupled to a line 1127 and is structured to provide power to the line 1127 at a voltage rating between 4.5 V and 16 V. The pin 1113 of the chip 1110 is coupled to a semiconductor device 1137 and is structured to selectively provide an actuating signal to the device 1137. The device 1137 is coupled to an automatic operator power supply 1139. In certain embodiments, the power supply 1139 is a latch actuator power supply. The device 1137 is also coupled to a ground 1145 by way of a resistive load 1141 and an indicator LED 1143. The resistive load 1141 may be a latch actuator or a powered door operator.

The pin 1114 of the chip 1110 is coupled to a power supply 1149 by way of a line 1167. The pin 1118 of the chip 1110 is coupled to the power supply 1149 by way of a line 1151 and a resistor 1153. The resistor 1153 is structured to reduce the current moving between the power supply 1149 and the chip 1110. The pin 1117 of the chip 1110 is coupled to the pin 1118 by way of a line 1155. The pin 1116 of the chip 1110 is coupled to a capacitor 1161. The anode of the capacitor 1161 is coupled to a line 1151 by way of a line 1159. The cathode of the capacitor 1161 is coupled to a ground 1163. The chip 1110 is coupled to the ground 1163 by way of the pin 1115, a line 1165 and a capacitor 1167. As illustrated in FIG. 11, the capacitor 1161 has a rating of 47 microfarads and the capacitor 1167 has a rating of 0.01 microfarads. The ratings of the capacitors 1161 and 1167 may be different to control the duration of the chip 1110 timing sequence.

In the illustrated embodiment, the grounds 1125, 1165, and 1163 are separate grounds. In certain embodiments, all grounds may be joined at one grounding point. Similarly, the power supplies 1129, 1149, and 1139 may represent the same power source.

Figure 12:
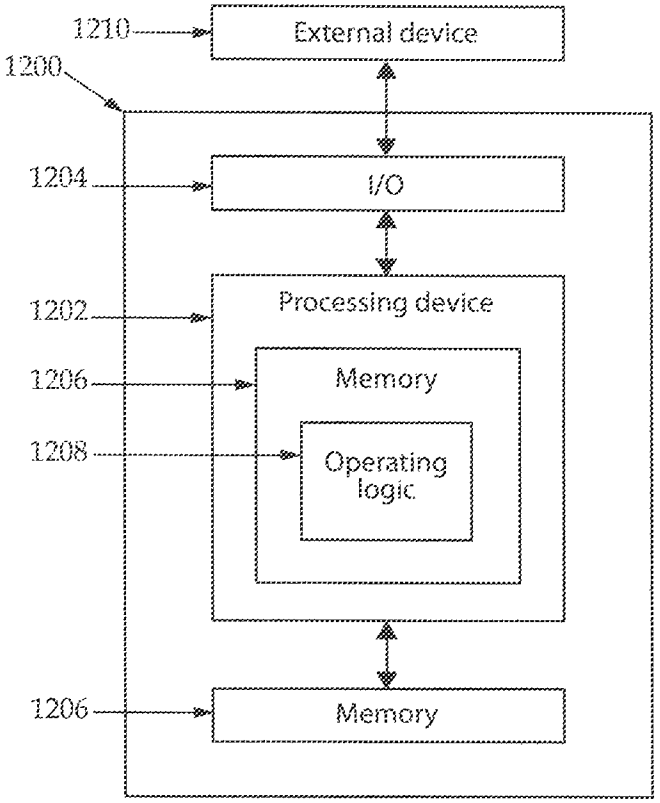
FIG. 12 is a block diagram illustrating a controller according to yet another embodiment.

FIG. 12 is a schematic block diagram of a computing device 1200. The computing device 1200 is one example of the controller which may be utilized in connection with the exit device assembly shown in FIGS. 1-3 and 7-10. The computing device 1200 includes a processing device 1202, an input/output device 1204, memory 1206, and operating logic 1208. Furthermore, the computing device 1200 communicates with one or more external devices 1210.

The input/output device 1204 allows the computing device 1200 to communicate with the external device 1210. For example, the input/output device 1204 may be a network adapter, network card, interface, or a port (e.g., a USB port, serial port, parallel port, an analog port, a digital port, VGA, DVI, HDMI, FireWire, CAT 5, or any other type of port or interface). The input/output device 1204 may be comprised of hardware, software, and/or firmware. It is contemplated that the input/output device 1204 includes more than one of these adapters, cards, or ports.

The external device 1210 may be any type of device that allows data to be inputted or outputted from the computing device 1200. For example, the external device 1210 may be a sensor, mobile device, a reader device, equipment, a handheld computer, a diagnostic tool, a controller, a computer, a server, a printer, a display, an alarm, an illuminated indicator such as a status indicator, a keyboard, a mouse, or a touch screen display. Furthermore, it is contemplated that the external device 1210 may be integrated into the computing device 1200. It is further contemplated that there may be more than one external device in communication with the computing device 1200.

The processing device 1202 can be of a programmable type, a dedicated, hardwired state machine, or a combination of these; and can further include multiple processors, Arithmetic-Logic Units (ALUs), Central Processing Units (CPUs), Digital Signal Processors (DSPs) or the like. For forms of the processing device 1202 with multiple processing units, distributed, pipelined, and/or parallel processing can be utilized as appropriate. The processing device 1202 may be dedicated to performance of just the operations described herein or may be utilized in one or more additional applications. In the depicted form, the processing device 1202 is of a programmable variety that executes algorithms and processes data in accordance with the operating logic 1208 as defined by programming instructions (such as software or firmware) stored in the memory 1206. Alternatively or additionally, the operating logic 1208 for processing device 1202 is at least partially defined by hardwired logic or other hardware. The processing device 1202 can be comprised of one or more components of any type suitable to process the signals received from the input/output device 1204 or elsewhere, and provide desired output signals. Such components may include digital circuitry, analog circuitry, or a combination of both.

The memory 1206 may be of one or more types, such as a solid-state variety, electromagnetic variety, optical variety, or a combination of these forms. Furthermore, the memory 1206 can be volatile, nonvolatile, or a combination of these types, and some or all of memory 1206 can be of a portable variety, such as a disk, tape, memory stick, cartridge, or the like. In addition, the memory 1206 can store data that is manipulated by the operating logic 1208 of the processing device 1202, such as data representative of signals received from and/or sent to the input/output device 1204 in addition to or in lieu of storing programming instructions defining the operating logic 1208, just to name one example. As shown in FIG. 12, the memory 1206 may be included with the processing device 1202 and/or coupled to the processing device 1202.

The processes in the present application may be implemented in the operating logic 1208 as operations by software, hardware, artificial intelligence, fuzzy logic, or any combination thereof, or at least partially performed by a user or operator. In certain embodiments, modules represent software elements as a computer program encoded on a computer readable medium, wherein a controller performs the described operations when executing the computer program.

A schematic flow diagram and related description which follows provides an illustrative embodiment of performing procedures of controlling an access control system such as the illustrated system 100 in FIG. 1. The described operations and functions are understood to be exemplary only, and in different embodiments, the operations and functions are combined in whole or in part, divided, added or removed, as well as re-ordered in whole or in part. It is contemplated that the various aspects, features, processing devices, processes, and operations from the various embodiments used in any of the other embodiments. Certain operations illustrated may be implemented by a computer executing a computer program product on a non-transient computer readable storage medium, where the computer program product includes instructions causing the computer to execute one or more of the operations, or to issue commands to other devices to execute one or more operations.

The following description of the process 1300 is made with reference to the door operator system 100 illustrated in FIGS. 1 and 2. It is to be understood, however, that the process 1300 may be utilized in combination with other forms of door operator systems, such as those described above with reference to FIGS. 7-10.

Figure 13:
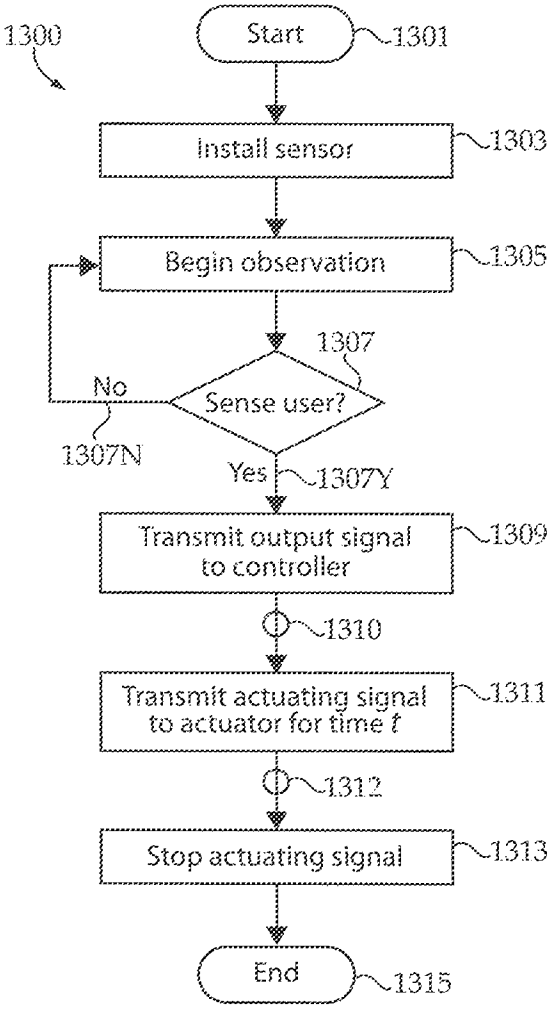
FIG. 13 is a schematic flow diagram of a latch operation process according to one embodiment.

With reference to FIG. 13, there is an exemplary process 1300 for unlatching a door 91. The process may begin with an operation 1303, which includes installing a sensor 117 in the housing of an exit device assembly 110. For example, the operation 1303 may include replacing an existing element of the housing assembly 140 with the retrofit plate 610 of kit 600, and installing the sensor 117 in the retrofit plate 610. The operation 1303 may further include installing the controller 119 and/or latch actuator 123. In other forms, the sensor 117, the controller 119, and/or latch actuator 123 may be installed at time of manufacture.

With the sensor 117 installed, the process 1300 proceeds to an operation 1305, in which the sensor 117 begins to observe an area in front of the sensor 117, such as the sensing region 214. The process 1300 proceeds to a conditional 1307, which includes determining whether a user 210 has been detected within the sensing region 214. If no user has been detected (1307N), the process 1300 reverts to the operation 1305. If a user has been detected (1307Y), the process 1300 proceeds to an operation 1309. At the operation 1309, the sensor 117 transmits an output signal 1310 to a controller 119. The process 1300 then proceeds to an operation 1311, in which the controller 119 transmits an actuating signal 1312 to a latch actuator 123 for a time period. The process 1300 proceeds to an operation 1313, in which the controller 119 stops transmitting the actuating signal 1312 to the latch actuator 123. The process 1300 then proceeds to a terminus 1315, in which the process 1300 is terminated.

It is contemplated that the various aspects, features, processing devices, processes, and operations from the various embodiments may be used in any of the other embodiments unless expressly stated to the contrary. Certain operations illustrated may be implemented by a computer executing a computer program product on a non-transient computer readable storage medium, where the computer program product includes instructions causing the computer to execute one or more of the operations, or to issue commands to other devices to execute one or more operations.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A method, comprising:

retrofitting an existing door operator assembly to thereby provide a retrofitted door operator assembly, wherein the existing door operator assembly comprises a latch and lacks a user-sensing device, and wherein the retrofitting comprises:

installing a sensor to the existing door operator assembly; and placing the sensor in communication with a latch actuator; and operating the retrofitted door operator assembly, wherein the operating comprises:

sensing, with the sensor, a user located a distance from the sensor; and in response to the sensing, transmitting an actuating signal to the latch actuator; and in response to the actuating signal, operating the latch actuator to transition the latch from a latched state to an unlatched state; and wherein the installing comprises replacing a removable component of the existing door operator assembly with a retrofit component comprising a window through which the sensor is operable to sense the user.

2. The method of claim 1, wherein the door operator assembly comprises an exit device.

3. The method of claim 2, wherein installing the sensor to the existing door operator assembly comprises installing the sensor to the exit device, and wherein the removable component of the existing door operator assembly is a removable component of the exit device.

4. The method of claim 2, wherein operating the latch actuator includes transitioning the latch from the latched state to the unlatched state before the user exerts a force on either the exit device or a door to which the exit device is mounted.

5. The method of claim 2, wherein the exit device is mounted to a door, and wherein transitioning the latch from the latched state to the unlatched state reduces a force required to open the door.

6. The method of claim 2, wherein operating the latch actuator includes transitioning the latch from the latched state to the unlatched state before the user reaches the exit device.

7. The method of claim 1, wherein the sensing the user comprises detecting the user in response to the user performing a predetermined gesture.

8. The method of claim 1, wherein the door operator assembly is coupled with a door, and wherein transitioning the latch from the latched state to the unlatched state reduces a force required to open the door.

9. The method of claim 1, wherein the retrofitting provides the retrofitted door operator assembly with a user-sensing capability not previously present in the existing door operator assembly.

10. A method, comprising:

retrofitting an existing door operator assembly to thereby provide a retrofitted door operator assembly, wherein the existing door operator assembly comprises a latch, and wherein the retrofitting comprises:

removing a removable component of the existing door operator assembly;

replacing the removable component with a retrofit component comprising a window through which a sensor is operable to sense a user located a distance from the sensor; and placing the sensor in communication with a latch actuator; and operating the retrofitted door operator assembly, comprising:

sensing, with the sensor, the user located the distance from the sensor;

in response to the sensing, transmitting an actuating signal to the latch actuator; and in response to the actuating signal, operating the latch actuator to transition the latch from a latched state to an unlatched state;

wherein the door operator assembly comprises an exit device including a housing assembly and a push pad movably mounted to the housing assembly;

wherein the sensor is mounted to the exit device;

wherein the door operator assembly is coupled with a door and further comprises a powered door operator; and wherein the method further comprises operating the powered door operator to reduce a force required to open the door.

11. The method of claim 10, wherein the push pad is movably mounted to the housing assembly and is operable to move the latch from the latched state to the unlatched state.

12. A method, comprising:

retrofitting an exit device including a removable component, wherein the retrofitting comprises replacing the removable component with a retrofit component of a retrofit kit, the retrofit kit further comprising a sensor mounted to the retrofit component and a controller electrically coupled to the sensor;

the retrofit kit configured to perform the steps of:

(a) detecting, via the sensor, a user located a distance from the sensor, the sensor transmitting an output signal in response to the detecting;

(b) receiving the output signal by the controller, the controller transmitting an actuating signal in response to receiving the output signal; and (c) receiving the actuating signal at a latch actuator, thereby actuating the latch actuator.

13. The method of claim 12, wherein the actuating the latch actuator results in transitioning a latch mechanism between a latched state and an unlatched state.

14. The method of claim 13, wherein transitioning the latch mechanism between the latched state and the unlatched state occurs before the user reaches the exit device.

15. The method of claim 13, wherein transitioning the latch mechanism between the latched state and the unlatched state occurs before the user exerts a force on the exit device.

16. The method of claim 12, wherein the removable component comprises one of a push pad, a mechanical case, or a center case.

17. The method of claim 12, wherein actuating the latch actuator reduces a force required to open a door on which the exit device is mounted.

18. The method of claim 12, wherein the retrofitting provides the exit device with a user-sensing capability not previously present in the exit device.

19. A method, comprising:

retrofitting an existing door operator assembly to thereby provide a retrofitted door operator assembly, the existing door operator assembly comprising a removable component and a latch, wherein the retrofitting comprises:

replacing the removable component with a retrofit component, the retrofit component comprising a sensor opening and a sensor aligned with the sensor opening, wherein the removable component lacks an opening corresponding to the sensor opening; and placing the sensor in communication with a latch actuator such that the latch actuator retracts the latch in response to the sensor detecting a user located a distance from the sensor.

20. The method of claim 19, further comprising operating the retrofitted door operator assembly, wherein the operating comprises:

detecting, by the sensor, the user located the distance from the sensor;

in response to the sensing, transmitting an actuating signal to the latch actuator; and in response to the actuating signal, operating the latch actuator to transition the latch from a latched state to an unlatched state.

* * * * *